US005387079A

United States Patent [19]

Levi

[11] Patent Number: 5,387,079

[45] Date of Patent: Feb. 7, 1995

[54] PUMPING STATE TURBOMOLECULAR PUMPS

[75] Inventor: Giampaolo Levi, Turin, Italy

[73] Assignee: Varian Associates, Inc., Palo Alto, Calif.

[21] Appl. No.: 140,699

[22] Filed: Oct. 21, 1993

Related U.S. Application Data

[63] Continuation of Ser. No. 903,439, Jun. 24, 1992, abandoned.

[30] Foreign Application Priority Data

Jul. 10, 1991 [IT] Italy ..... T091A000536

[51] Int. Cl.[6] ..... F01D 1/36

[52] U.S. Cl. ..... 415/90

[58] Field of Search ..... 415/90, 148, 150, 159, 415/160

[56] References Cited

U.S. PATENT DOCUMENTS 3,291,236 12/1966 Foshag et al. ..... 415/160
3,820,916 6/1974 Agushev et al. ..... 415/160
4,531,372 7/1985 Slabaugh ..... 415/160
4,768,921 9/1988 Shinjiro et al. ..... 415/90
5,158,426 10/1992 Casaro et al. ..... 415/90

FOREIGN PATENT DOCUMENTS 2250559 4/1974 Germany ..... 415/160
239397 10/1988 Japan ..... 415/90

*Primary Examiner*—John T. Kwon
*Attorney, Agent, or Firm*—Edward H. Berkowitz; David J. Power; Bella Fishman

[57] ABSTRACT

The present invention refers to a pumping stage for turbomolecular pumps comprising a rotor disk (3), integral with a rotating shaft (4) operated by a motor, and a stator disk (1) said stator disk (1), integral with the pump body (2), where the stator disk (1) is a disk whose surface is substantially smooth that can assume, during the evacuation cycle, a bladed configuration, by raising radial sections (5) of the disk surface itself. Raising of radial sections (5) is performed by at least one actuator device (11) controlled, through an electronic control device (12), by a pressure sensor (13) sampling the pressure inside the pump body (2).

6 Claims, 2 Drawing Sheets

PUMPING STATE TURBOMOLECULAR PUMPS

This application is a continuation of application Ser. No. 07/903,439, filed Jun. 24, 1992, now abandoned.

FIELD OF THE INVENTION

The present invention deals with a rotor-stator stage for turbomolecular pumps of the type in which a series of pumping stages is housed inside a cylindrical body.

BACKGROUND OF THE INVENTION

The pumping stages for turbomolecular pumps are traditionally composed of pairs of disks, one of which (the stator disk) is integral with the pump body, while the other one (the rotor disk) is integral with a shaft that is centrally placed with respect to the pump body and the stator disk and rotated by a motor.

Both such disks are commonly equipped with blades, the number of which ranges between 20 and 60: these are oriented with opposite blade aspect with respect to the rotation plane, in order to perform pumping of gas molecules with the rotor disk and changing the speed distribution of gas molecules with the stator disk.

In particular, the number of disk blades, and consequently their pitch, generates the capability of compressing gases at a certain speed.

The function of the stator disk is mainly change the speed distribution for gas molecules after they have been pumped by the rotor disk, to be intercepted and pumped by the rotor disk in the following pumping stage.

If the pumping stage lacked a stator disk, the gas molecules would not be pumped by the rotor disk in the following stage; in fact, they leave the rotor disk with a speed distribution whose maximum is next to the opening angle of the rotor that pumped them, and therefore only a negligible portion of these molecules could be intercepted by the following rotor disk.

Since these pumping stages are configured to obtain a high degree of vacuum (that is, very low pressure, the rotor-stator stage efficiency is high only next to low pressure inside the body, that is in extreme rarefaction situations where friction between pumping stage disks and present gas is negligible, while efficiency remains low at the beginning of the evacuation cycle, during which the pump works with viscous gases and the process is governed either by a fore vacuum pump or by possible stages with adequate geometries, integral with the turbomolecular pump shaft.

In the first operating stage of the pump, that is when gas pressure in the body is close to the atmospheric pressure (about 1000 mbar), the presence of a traditional bladed stator disk is therefore disadvantageous, since its deflection function is negligible, while power absorption by friction with present gas is very high.

It has been verified experimentally that a turbomolecular pump having a pumping stage without a stator disk, absorbs, in a steady state rotation, about 17 Watts at 90 Hz and about 50 Watts at 160 Hz, while a pump equipped with traditional stages including bladed stator disks absorbs about 190 Watts at 80 Hz.

The purpose of the present invention is to provide a pumping stage for turbomolecular pumps configured in such a manner as to save the absorbed power during the initial stage of the evacuation cycle without losses in the pumping capacity of the pump itself.

These and other purposes are reached by a pumping stage for turbomolecular pumps comprising a rotor disk and a stator disk integral with the pump body and centrally drilled, characterized in that the stator disk is a disk the surface of which is substantially smooth, said surface being able to assume, during the evacuation cycle, a bladed configuration through lifting its radial sections, said lifting of radial sections being controlled by at least one operating mechanism.

Further properties and advantages of the invention will better appear from the following description with reference to the enclosed drawings in which.

Figure 1:
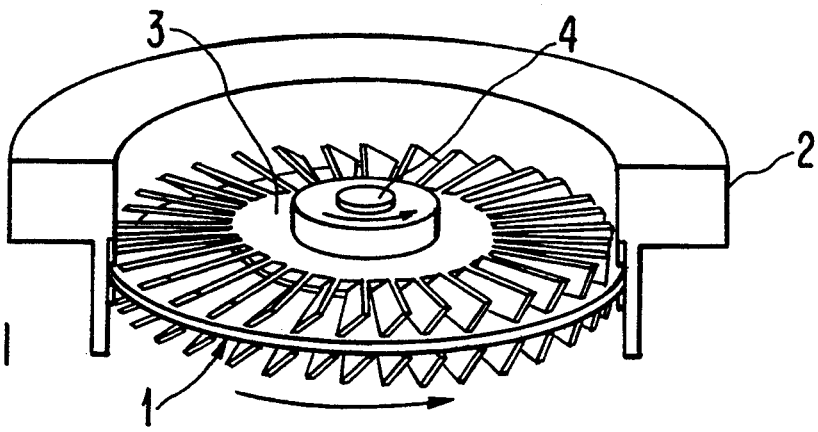
FIG. 1 is a global view of the rotor-stator stage housed in the cylindrical body, where the stator disk is a smooth disk.
Figure 2:
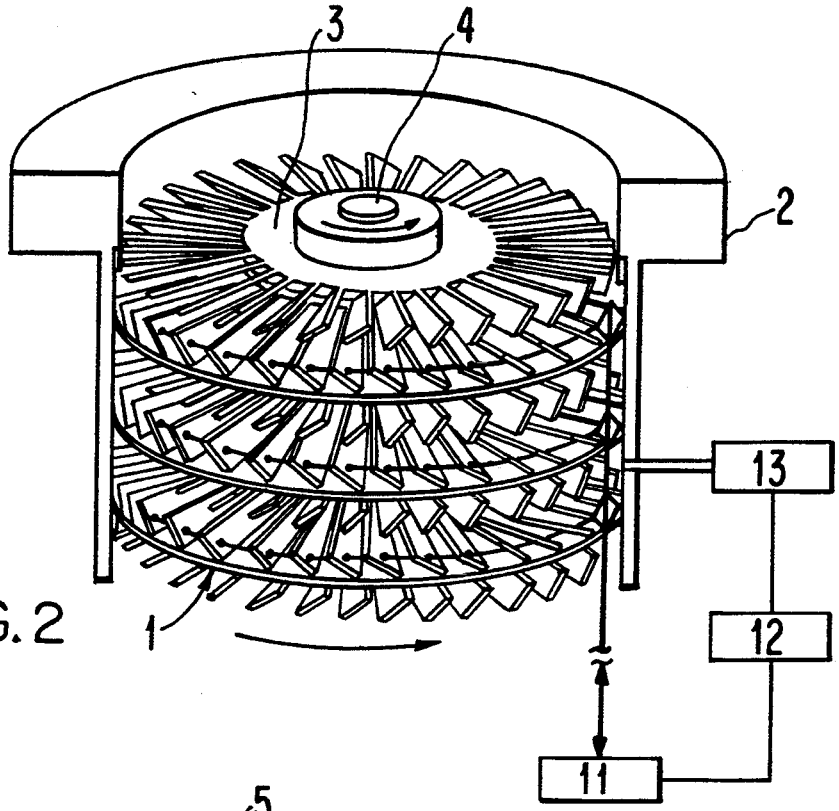
FIG. 2 is a view of a plurality of rotor-stator stages housed in the cylindrical body, where the stator disks are represented in their configuration with bladed surfaces.
Figure 3:
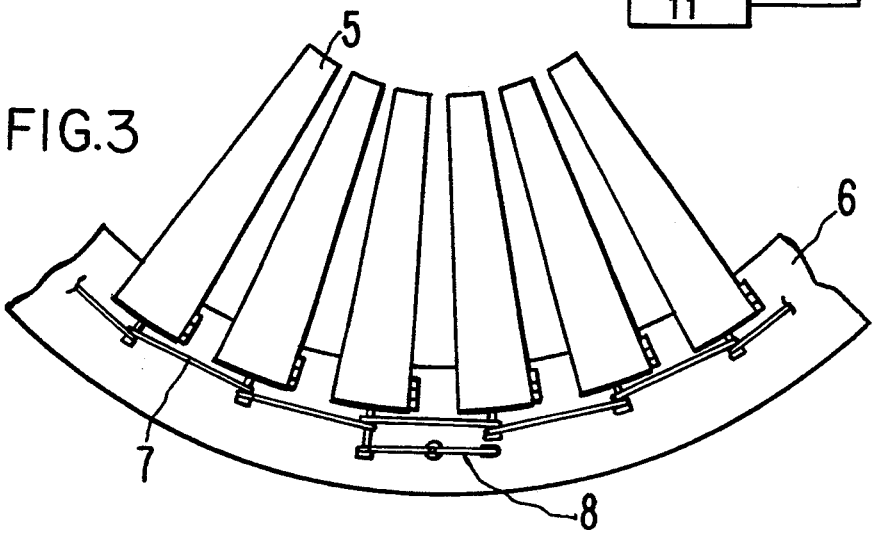
FIG. 3 is a top view of a section of the stator disk in a bladed configuration.
Figure 5:
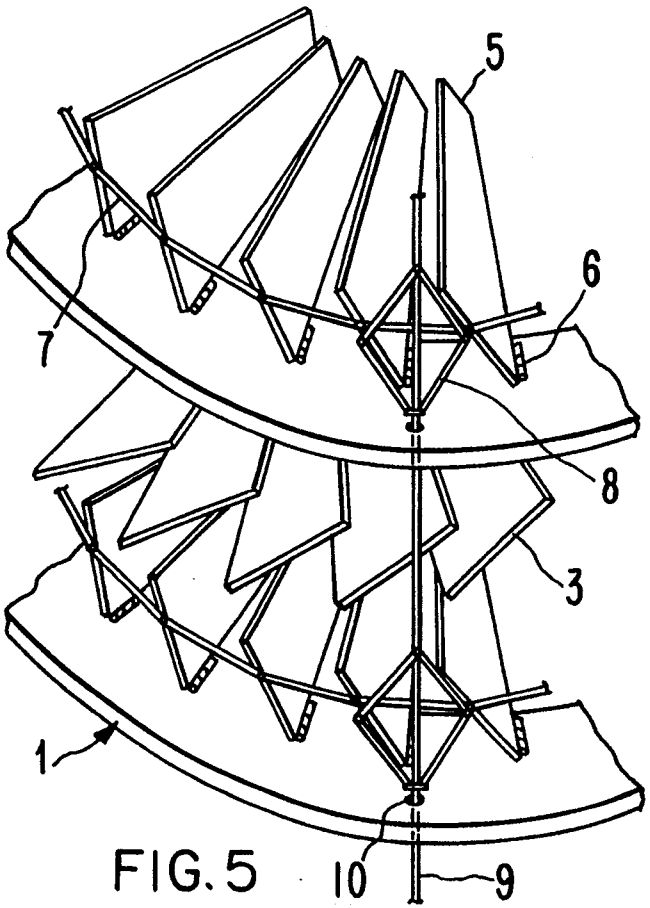
FIG. 5 is a partial view of a rotor-stator stage and stator disk of the following stage with the lifting mechanism for radial section.
Figure 4:
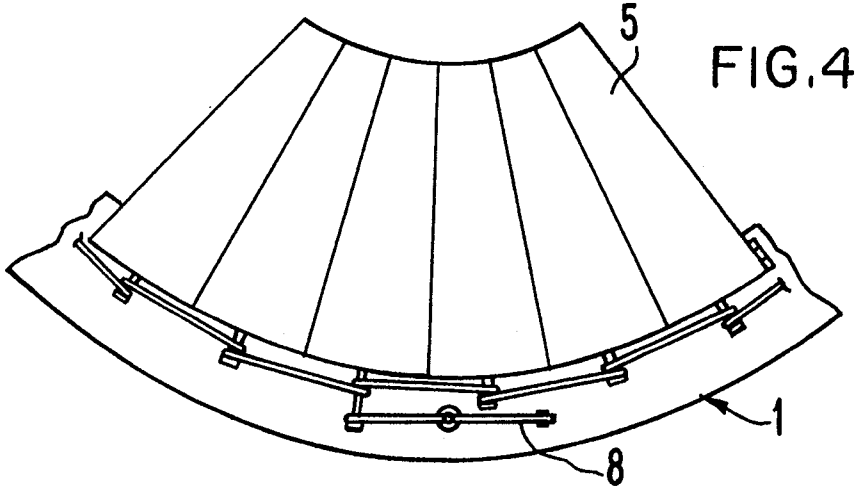
FIG. 4 is a top view of a section of the stator disk in a smooth configuration.
Figure 6:
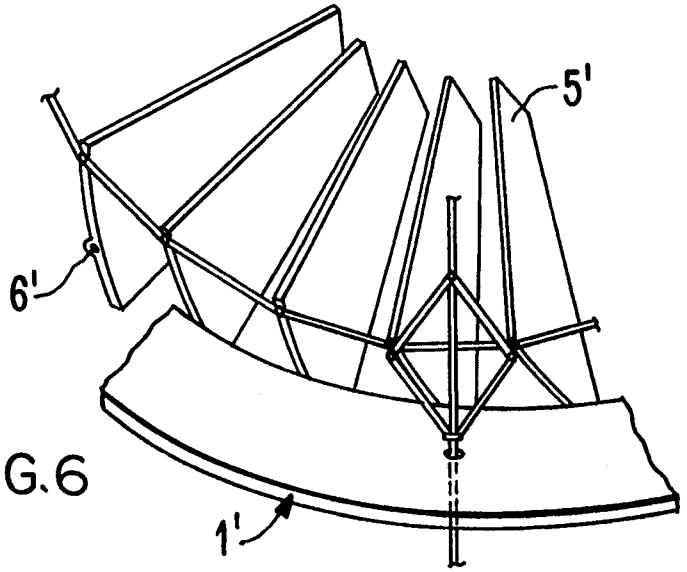
FIG. 6 is a partial view of a stator disk with hinged blades according to a modified embodiment.

With reference to the enclosed figures, a preferred, but not limiting, embodiment of the invention will now be described.

The pumping stage for turbomolecular pumps is composed of a stator disk 1, housed inside a turbomolecular pump body 2 and integral with it, and a rotor disk 3, integral with the central shaft 4 rotated by a motor (not shown).

On the upper surface of the stator disk 1, some blades 5 are present and fixed, through hinges 6, to the part of that stator disk 1 that is integral with the pump body 2. These blades 5 are furthermore equipped with control tie rods 7, operated by a pantograph mechanism 8 that transforms the vertical movement of a rod 9 into horizontal movement. A hole 10, drilled into the area of the stator disk 1 integral with the turbomolecular pump body 2, enables rod 9 to pass through the plurality of pumping stages included in the turbomolecular pump body 2.

The control tie rod 9 is instantaneously operated by an actuator device 11 controlled, through an electronic control device 12, by a pressure sensor 13 inside the turbomolecular pump body 2, for example when a 1 mbar pressure is reached.

In a modified embodiment of the invention, blades 5' are rotatingly fixed through eyelets 6' to the internal edge of the stator disk 1' part that is housed inside the turbomolecular pump body.

In the configuration according to the invention with smooth stator disk, the pump absorbs about 20 Watts at 80 Hz and about 154 Watts at 160 Hz.

Moreover, in this latter configuration, the effect of the smooth stator disk being present is relevant as regards molecule deflection, distributing their speed again, even when the disk is kept in this configuration during the whole evacuation cycle.

I claim:

1. A turbomolecular pump comprising a housing having a plurality of pumping stages disposed therein, each of said stages comprising a rotor disk and a stator disk, said stator disk integral with the pump housing and centrally aligned therewith, said stator disk further comprising a plurality of radially directed blades, each of said blades having a radially directed longitudinal axis, said stator blades adaptedly mounted to said housing for rotation about said radially directed axis, whereby, the pivotal movement of said stator blades is dynamically controlled by at least one operating mechanism.

2. The turbomolecular pump of claim 1 wherein each said rotor disk and said stator disk having substantially smooth opposing planar surfaces and a peripheral surface positioned adjacent and in close tolerance to a corresponding internal surface of the pump housing.

3. The turbomolecular pump according to claim 1 further comprising an actuating means operably coupled to the stator blades for adjusting of said stator blade.

4. The turbomolecular pump according to claim 3, wherein the stator blades are joined by a connection means.

5. The turbomolecular pump according to claim 4, wherein said actuating means is at least one pantograph mechanism, said pantograph mechanism is operated by a rod means passing through the surface of the stator disk crown, said rod means operated by an electromechanical device being activated by a signal originating from a pressure sensor inside the pump body in cooperation with an electronic control means.

6. The method of operating a turbomolecular pump comprising a plurality of pumping stages, each respective stage having a rotor disk and a stator disk, said stator disk further comprising a plurality of radially directed blades, said method comprising the steps of;

(a) rotating said rotor disk of the pumping stage whereby to direct gas molecules toward a stator disk of a said pumping stage along a path having a substantial axial component, (b) redirecting gas molecules impelled by said rotor with said stator disk, said stator disk having each of its respective blades disposed at a first angle to the plane of rotation of said rotor to create a baffle effect within said stage, (c) measuring the pressure within said pump stage, and (d) changing said first angle to another angle of said stator blades in cooperation with the result of said measuring.

* * * * *